US007707760B2

(12) United States Patent
Gablowski

(10) Patent No.: US 7,707,760 B2
(45) Date of Patent: May 4, 2010

(54) SAFETY APPARATUS FOR WEAPONS

(75) Inventor: Jurgen Gablowski, Oberndorf (DE)

(73) Assignee: Heckler & Koch GmbH, Oberndorf/Neckar (DE)

( * ) Notice: Subject to any disclaimer, the term of this patent is extended or adjusted under 35 U.S.C. 154(b) by 161 days.

(21) Appl. No.: 12/128,410

(22) Filed: May 28, 2008

(65) Prior Publication Data

US 2009/0320346 A1 Dec. 31, 2009

Related U.S. Application Data

(63) Continuation of application No. PCT/EP2006/011418, filed on Nov. 28, 2006.

(30) Foreign Application Priority Data

Nov. 30, 2005 (DE) ..... 10 2005 057 130

(51) Int. Cl.
*F41A 17/00* (2006.01)
*F41A 21/48* (2006.01)
*F41A 9/29* (2006.01)

(52) U.S. Cl. ..... 42/70.01; 42/75.01; 89/14.05; 89/33.2

(58) Field of Classification Search ..... 42/70.01, 42/75.01, 75.1; 89/14.05, 33.2
See application file for complete search history.

(56) References Cited

U.S. PATENT DOCUMENTS

| | | | | |
|---|---|---|---|---|
| 2,611,297 A | | 9/1952 | Simpson | |
| 3,386,336 A | * | 6/1968 | Roy | 89/128 |
| 3,955,469 A | * | 5/1976 | Conley | 89/33.14 |

(Continued)

FOREIGN PATENT DOCUMENTS

| | | |
|---|---|---|
| DE | 3014541 C2 | 9/1981 |
| DE | 3541312 C2 | 5/1987 |
| DE | 4345228 A1 | 4/1995 |
| EP | 0423677 | 4/1991 |

OTHER PUBLICATIONS

International Searching Authority, "International Search Report", for counterpart PCT application Serial No. PCT/EP2006/011418, mailed Mar. 21, 2007 (6 pages).
International Bureau, "International Preliminary Report on Patentability", issued in connection with counterpart PCT application serial No. PCT/EP2006/011418, mailed Jul. 17, 2008 (6 pages).

*Primary Examiner*—Bret Hayes
(74) *Attorney, Agent, or Firm*—Hanley, Flight and Zimmerman, LLC

(57) ABSTRACT

Methods and apparatus are described for safety apparatuses for weapons. An example safety apparatus includes an interchangeable barrel and a safety mechanism. The safety mechanism can be moved between an open position that corresponds to an unlocked position and a closed position that corresponds to a locked position. The safety mechanism includes a feeder cover that is part of cartridge loading equipment that supplies cartridges to the weapon. The feeder cover includes a locking mechanism that engages with a barrel locking device and prevents the feeder cover from entering the closed position if the interchangeable barrel is not coupled to the weapon via the barrel locking device. Further, the unlocked position prevents the weapon from being fired and the locked position allows the weapon to be fired. Additionally, the barrel locking device couples the interchangeable barrel to the weapon and wherein the barrel locking device interacts with a safety mechanism and prevents the safety mechanism from entering the locked position if the interchangeable barrel is not coupled to the weapon via the barrel locking device.

20 Claims, 5 Drawing Sheets

U.S. PATENT DOCUMENTS 4,066,000 A * 1/1978 Rostocil ..... 89/198
4,244,270 A * 1/1981 Tassie ..... 89/33.2
4,418,607 A * 12/1983 Price ..... 89/33.25
5,736,667 A * 4/1998 Munostes et al. ..... 89/132
6,176,169 B1 * 1/2001 Rostocil ..... 89/28.05
2003/0066228 A1 * 4/2003 Smith ..... 42/70.11

* cited by examiner

SAFETY APPARATUS FOR WEAPONS

RELATED APPLICATION

This patent is a continuation of International Patent Application Serial No. PCT/EP2006/011418, filed Nov. 28, 2006, which claims priority to German Patent Application 10 2005 057 130.1, filed on Nov. 30, 2005, both of which are hereby incorporated herein by reference in their entireties.

FIELD OF THE DISCLOSURE

The application relates generally to safety apparatuses for weapons, and specifically, to safety apparatus for weapons with interchangeable barrels.

BACKGROUND

Weapons are often equipped with interchangeable barrels. After a cartridge is ignited, a projectile is pushed through a passageway of the barrel creating vibration and stress that is absorbed through oscillations of the barrel. During continuous firing or rapid projectile releases, overheating of the barrel may result due to friction energy from the projectile in the barrel and gas pressure from igniting the propellant in the cartridges. In some instances, overheating of the barrel can result in a gas pressure inside of an ignited cartridge shell to increase to a level that causes the cartridge shell to break apart and, thus, block a cartridge chamber. Additionally, continuous firing, especially of high caliber ammunition such as machine guns and grenade launchers, increases the temperature of the barrel causing the barrel to expand and, thus, reducing shot precision and hit rate.

Known weapons have been provided with interchangeable barrels that are able to be interchanged regardless of the number of shots fired. Typically, the interchangeable barrel is bolted with a holding bracket or coupled to the holding bracket in another manner. The rear end of the interchangeable barrel is provided with a cartridge chamber where cartridges are loaded and ignited (e.g., fired). Igniting rounds in the cartridge chamber produces high gas pressure and, therefore, the walls of the cartridge chamber are typically stronger than that of the interchangeable barrel. If the cartridge is in the correct position in the cartridge chamber while the cartridge is ignited, the cartridge shell can seal the gas pressure in the barrel. Typically, the cartridge chamber forms a negative imprint on the cartridge shell that is typically made of a relatively soft and flexible copper-brass-alloy. After the cartridge is ignited, the cartridge shell normally conforms exactly to the walls of the cartridge chamber and, thus, seals the gas pressure produced within the interchangeable barrel.

Alternatively, if the interchangeable barrel is not correctly mounted, bolted and/or locked on the holding bracket due to, for example, operating errors, the cartridge shell will not correctly fit into the cartridge chamber and, therefore, the cartridge shell will not seal the gas pressure in the interchangeable barrel. This may cause the firing pin not to reach a cap of the cartridge preventing the release of the projectile and causing a jam. Alternatively, if the firing pin reaches the cap and an ignition takes place, the non-sealed gas pressure can cause the barrel to explode causing serious injury to the operator.

There is a large selection of known safety mechanisms related to trigger mechanisms, locking systems, etc. that have the intention of preventing an automatic or unintentional ignition of a cartridge. However, in weapons with interchangeable barrels, these known safety mechanisms do not prevent shots from being fired if interchangeable barrel is not correctly mounted, bolted and/or locked and, thus, they create a considerable danger for the weapon operator and/or other bystanders.

A known example, DE 35 41 312 C2, describes a locking mechanism that interacts with a firing pin locking device so that a firing pin is blocked and is unable to reach the cartridge head if the barrel is released. Additionally, DE 35 41 312 C2 describes a release clamp to lock and release the barrel of portable automatic firearms that blocks a weapon lock if the barrel is released.

DETAILED DESCRIPTION

Certain examples are shown in the above-identified figures and described in detail below. In describing these examples, like or identical reference numbers are used to identify common or similar elements. The figures are not necessarily to scale and certain features and certain views of the figures may be shown exaggerated in scale or in schematic for clarity. Further, throughout this description, position designations such as "above," "below," "top," "forward," "rear," "left," "right," etc. are referenced to a firearm held in a normal firing position (i.e., wherein the "shooting direction" is pointed away from the marksman in a generally horizontal direction) and from the point of view of the marksman. Furthermore, the normal firing position of the weapon is always assumed, i.e., the position in which the barrel runs along a horizontal axis.

The disclosure and the illustrated examples relate to a weapon 1 comprising an interchangeable barrel 4, a barrel locking device 22 that can couple the interchangeable barrel 4 to the weapon 1, and a safety mechanism that can be placed in a locked position or an unlocked position. When the safety mechanism is in the unlocked position, the safety mechanism prevents the weapon 1 from firing a cartridge (e.g., igniting a cartridge, releasing a shot, etc.). Alternatively, when the safety mechanism is in the locked position, the safety mechanism allows the weapon 1 to fire a cartridge. In some examples, the safety mechanism includes the barrel locking device 22. The barrel locking device 22 prevents the safety mechanism from entering the locked position if the interchangeable barrel 4 is not coupled to the weapon 1 via the barrel locking device 22.

Although the disclosure and the illustrated examples relate to a grenade launcher, persons of ordinary skill in the art will readily appreciate that the disclosed apparatus can be used in any suitable firearm or weapon that has an interchangeable barrel such as, for example, rifles, machine guns, pistols, assault weapons, cannons, naval guns, stationary guns mounted on a weapon carrier, weapons that fire small or large diameter bullets etc.

Figure 1A:
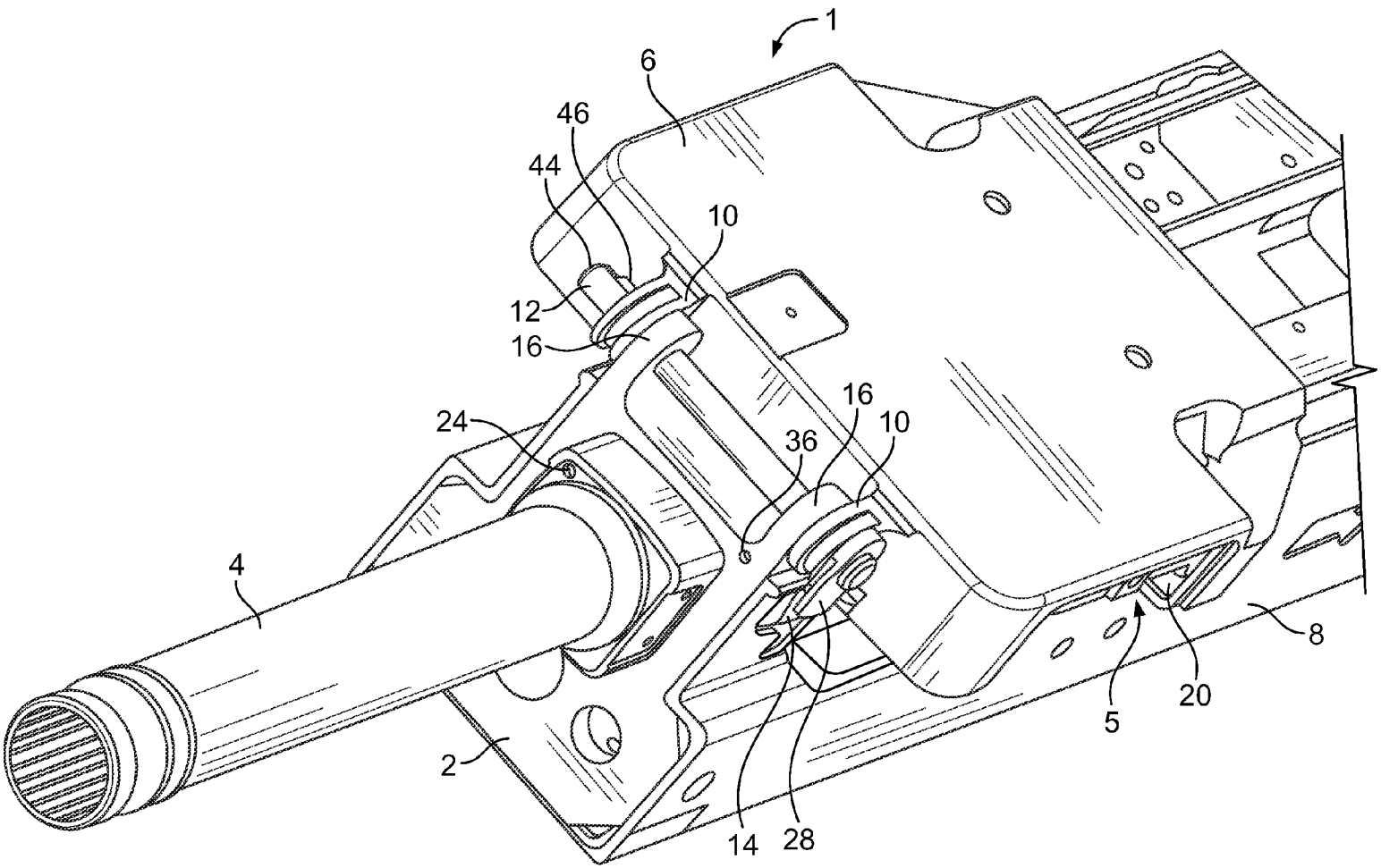
FIG. 1*a* illustrates a perspective view of an example weapon including an example interchangeable barrel, an example barrel locking device, and an example safety mechanism.

FIG. 1*a* illustrates a perspective view of the example weapon 1 (e.g., grenade launcher) including the example interchangeable barrel 4, the example barrel locking device 22, and the example safety mechanism. In some examples, the weapon 1 includes a holding bracket 2 that receives the interchangeable barrel, a cartridge feeding device 5, a feeder cover 6, and a housing 8. In the remainder of the disclosure, components of the weapon 1 such as, for example, a locking system, a trigger mechanism, etc. are not further described because they are known in the art. For a description of the components of a grenade launcher assembly see, for example, German patent DE 43 45 228 A1.

In this example, the holding bracket 2 is coupled to the front end of the housing 8 and guides the interchangeable barrel 4 along substantially the center of a cartridge chamber (not shown). The interchangeable barrel 4 may be inserted (e.g., received) into the holding bracket 2.

In the illustrated example, the feeder cover 6 is comprised of a flat container with an opening (not shown) towards the bottom that includes a belt infeed (not shown) on an exterior face. The belt infeed is provided with two guiding channels 20 that are opposite one another and are separated by a distance that, in some examples, corresponds to a diameter of a cartridge (not shown) near a cartridge head (not shown) or a cartridge bottom (not shown) and the distance may additionally include, in some examples, a wall thickness of a belt that operatively couples the individual cartridges together. The feeder cover 6 is rotatable about an axis between an open position and a closed position and at least a portion of the feeder cover 6 is substantially torque proof. The safety mechanism also comprises preventing the cartridge from being supplied to the cartridge chamber if the feeder cover 6 is in the open position and, thus, prevents the cartridge from being fired. Additionally, the safety mechanism may prevent a cartridge from being fired that is in the cartridge chamber by blocking the locking system and/or the trigger mechanism from coming into contact with the cartridge.

In this example, the feeder cover 6 is provided with a plurality of first eyelets 10 and the holding bracket 2 is provided with a plurality of corresponding second eyelets 16. The plurality of first eyelets 10 and the plurality of second eyelets 16 have through holes that have substantially the same diameter corresponding to a diameter of a locking member 12. The feeder cover 6 and the holding bracket 2 may be coupled together in any suitable manner such as, for example, guiding the locking member 12 through the plurality of first eyelets 10 and the plurality of second eyelets 16. The locking member 12 may be positioned substantially lateral relative to the interchangeable barrel 4. The feeder cover 6 is rotatable around the locking member 12. In the illustrated example of FIG. 1*a*, the feeder cover 6 is in the closed position that allows for the cartridges to be supplied laterally via the cartridge feeding device 5 crosswise to the interchangeable barrel 4 and over a lock (not shown) of the cartridge chamber. In some examples, after the cartridge is fired, the empty shell casing (not shown) may be ejected via an ejection window (not shown) positioned opposite of the belt infeed.

In the illustrated examples, the locking member 12 is provided with a locking spring 46 that protrudes from the locking member 12 and is positioned at an end 44 of the locking member 12. The locking spring 46 may secure the position of the locking member 12 relative to the plurality of first eyelets 10 and the plurality of second eyelets 16 and may prevent the locking member 12 from being unintentionally removed or dropped. To remove the locking member 12, the locking spring 46 may be pushed by hand or with a tool into the locking member 12 so that the locking spring 46 protrudes less from the locking member 12 and, thus, the locking member 12 can be extracted through the first plurality of eyelets 10 and through the second plurality of eyelets 16. Removing the locking member 12 from the first plurality of eyelets 10 and the second plurality of eyelets 16 allows for the feeder cover 6 to be removed to be cleaned or for any other purpose such as, for example, replacing the feeder cover 6 or for other maintenance of the weapon 1.

In this example, the interchangeable barrel 4 may be coupled to the holding bracket 2 into the locked position by a barrel locking device 22 via a barrel retaining element 14. The interchangeable barrel 4 is provided with guide rings 3 (FIG. 1*c*) that are positioned near an end of the interchangeable barrel 4 and may at-least partially facilitate the centering of the interchangeable barrel 4 in the holding bracket 2 if the interchangeable barrel 4 is inserted into the holding bracket 2. In the illustrated examples, a first guide ring 3 is provided with a lateral slot 7 (FIG. 1*c*) that corresponds to a projection (not shown) inside of the holding bracket 2 that allows the interchangeable barrel 4 to be rotationally coupled to the holding bracket 2. If the interchangeable barrel 4 is at a stop limit (not shown), the interchangeable barrel 4 can be placed in the locked position. To lock the interchangeable barrel 4 into position, the barrel retaining element 14 is inserted into a partially tubelike guide 39 (FIG. 1*b*) to a stop limit stop (not shown). An exterior diameter of the retaining element 14 substantially corresponds to an interior diameter of the tubelike guide 39. The guide 39 is comprised of a groove 40 that is positioned on one of the guide rings 3 on the interchangeable barrel 4 in combination with a crosswise slot 42 that is substantially parallel above the guide rings 3. Ends of the barrel retaining element 14 may be mounted in a plurality of drill holes 15*a* and 15*b* in the holding bracket 2.

In the illustrated example, the barrel locking device 22 may include a sensor element 24 (e.g., a sensor pin 24). A projection 34 (FIG. 2) is positioned substantially parallel to the interchangeable barrel 4 and may be coupled to the interchangeable barrel 4 opposite the cartridge chamber. In some examples, the projection 34 may engage (e.g., push) the sensor element 24. If the interchangeable barrel 4 is inserted into the holding bracket 2, the projection 34 (FIG. 2) engages the sensor element 24 and moves the sensor element 24 from a second sensor element position to a first sensor element position by, for example, overcoming a biasing force of a sensor element spring 25. The sensor element spring 25 may be positioned parallel to the direction of the interchangeable barrel 4 in the holding bracket 2. In the illustrated example of FIG. 1*a*, the interchangeable barrel 4 is at the stop limit and, therefore, the sensor element 24 is in the first sensor element position.

In this example, the sensor element 24 is provided with a recess 30 on an upper side of the sensor element 24. In a first sensor element position, the sensor element 24 is pushed into the holding bracket 2 and the recess 30 may be substantially flush with the groove 40 of the guide 39 and, therefore, a passage for the lower area of the guide 39 is formed. The barrel retaining element 14 is insertable through the guide 39 into the locking position; however, if the sensor element 24 is not in the first sensor element position the sensor element 24 may prevent the barrel retaining element 14 from being fully inserted into the guide 39.

In some examples, a locking mechanism 26 (FIGS. 3*a* and 3*b*) interacts with the barrel locking device 22 and prevents the feeder cover 6 from closing (i.e., entering the closed position) if the interchangeable barrel 4 is not correctly positioned and/or locked (i.e. coupled) in the holding bracket 2. The locking mechanism 26 is provided with a blocking plate 28 that may be coupled to an outside edge of the feeder cover 6 and positioned toward the interchangeable barrel 4. Additionally, the blocking plate 28 may be positioned substantially perpendicular (i.e., vertical) relative to a bottom face of the feeder cover 6. The barrel retaining element 14 protrudes from the guide 39 if the barrel retaining element 14 is not at the second stop limit (e.g., the locked position) and, therefore, the barrel retaining element 14 may prevent the feeder cover 6 from being in a closed position via the blocking plate 28. If the barrel retaining element 14 is not in the locked position, as the feeder cover 6 is moving toward the closed position, the barrel retaining element 14 engages the blocking plate 28 (FIGS. 3*a* and 3*b*) and prevents the feeder cover 6 from being in the closed position.

Additionally, in the feeder cover 6 closed position, if the barrel retaining element 14 is in the locked position the blocking plate 28 may prevent removal, dropping, etc. of the barrel retaining element 14 by, for example, blocking and/or engaging an end of the barrel retaining element 14.

In the illustrated examples, if the barrel retaining element 14 is removed from the holding bracket 2 for any reason such as, for example, to remove the interchangeable barrel, a stop pin 36 (FIG. 1*a*-1*c*) is provided that prevents the barrel retaining element 14 from being entirely removed from the guide 39. The stop pin 36 may be substantially parallel to the interchangeable barrel 4 and may be positioned above and/or substantially perpendicular to the barrel retaining element 14. Additionally, the stop pin 36 may be positioned on the side of the holding bracket 2 and may face the blocking plate 28. The barrel retaining element 14 may be provided with a leveled impression 48 (FIG. 1*b*) that my run in a longitudinal direction between the ends of the barrel retaining element 14. The impression 48 and the stop pin 36 may restrict the longitudinal movement of the barrel retaining element 14 to the length of the impression 48. In some examples, the stop pin 36 prevents the complete removal of the barrel retaining element 14 by engaging an end of the impression 48 opposite a head 50 of the barrel retaining element 14 (i.e., a stop pin limit).

Figure 1B:
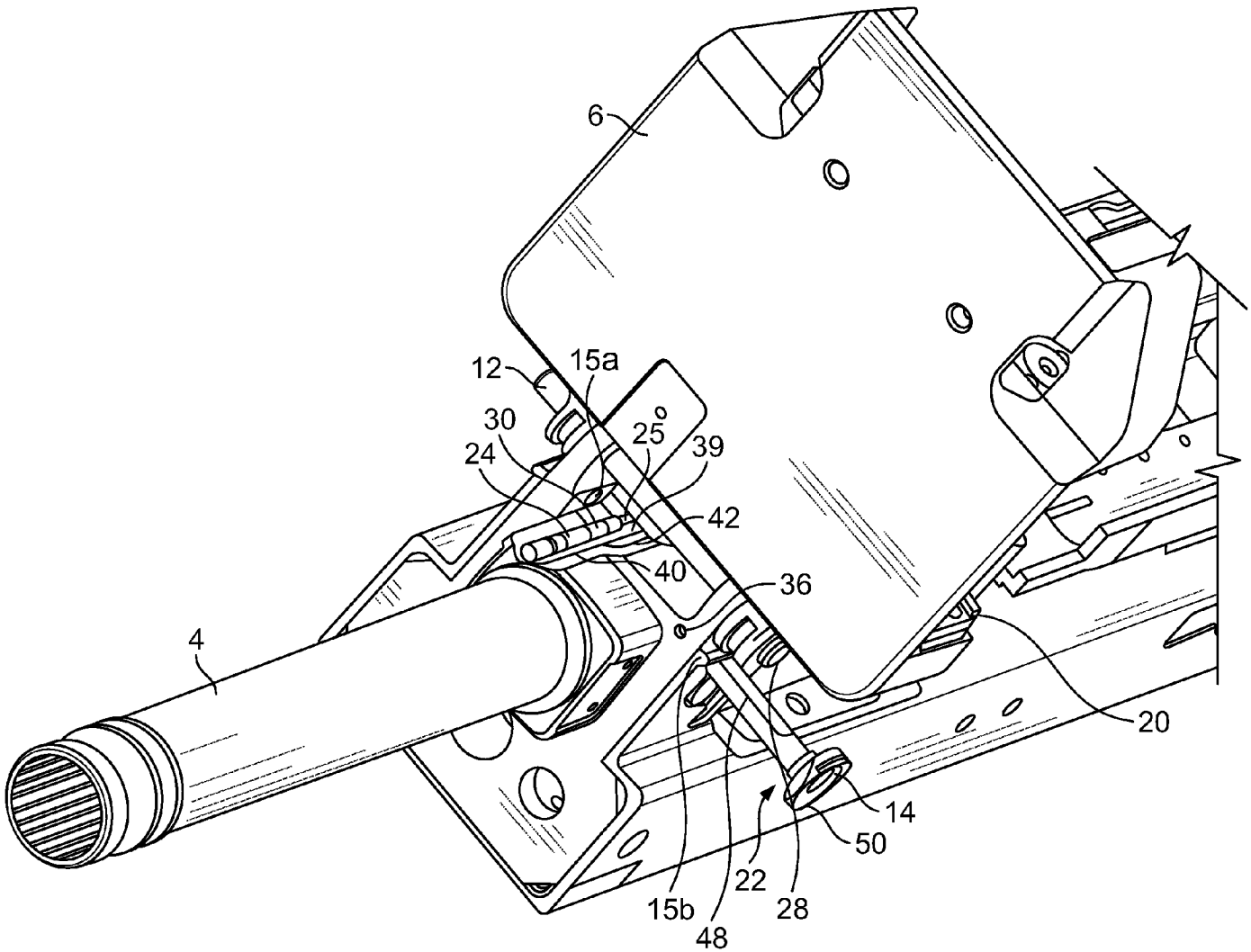
FIG. 1*b* illustrates a perspective view of the weapon of FIG. 1*a* with an example feeder cover in an open position.

FIG. 1*b* is an illustrated example of a perspective view of the example weapon 1 of FIG. 1*a* with an example feeder cover 6 in the open position (e.g., rotated by 90 degrees). In the open position, the blocking plate 28 may not engage the head 50 of the barrel retaining element 14 and, thus, the barrel retaining element 14 may be removed from (e.g., disengage) the groove 40 at the stop ring. FIG. 1*b* illustrates the barrel retaining element 14 extracted from the guide 39 to the stop pin limit, which may allow for the interchangeable barrel 4 to be exchanged.

Figure 1C:
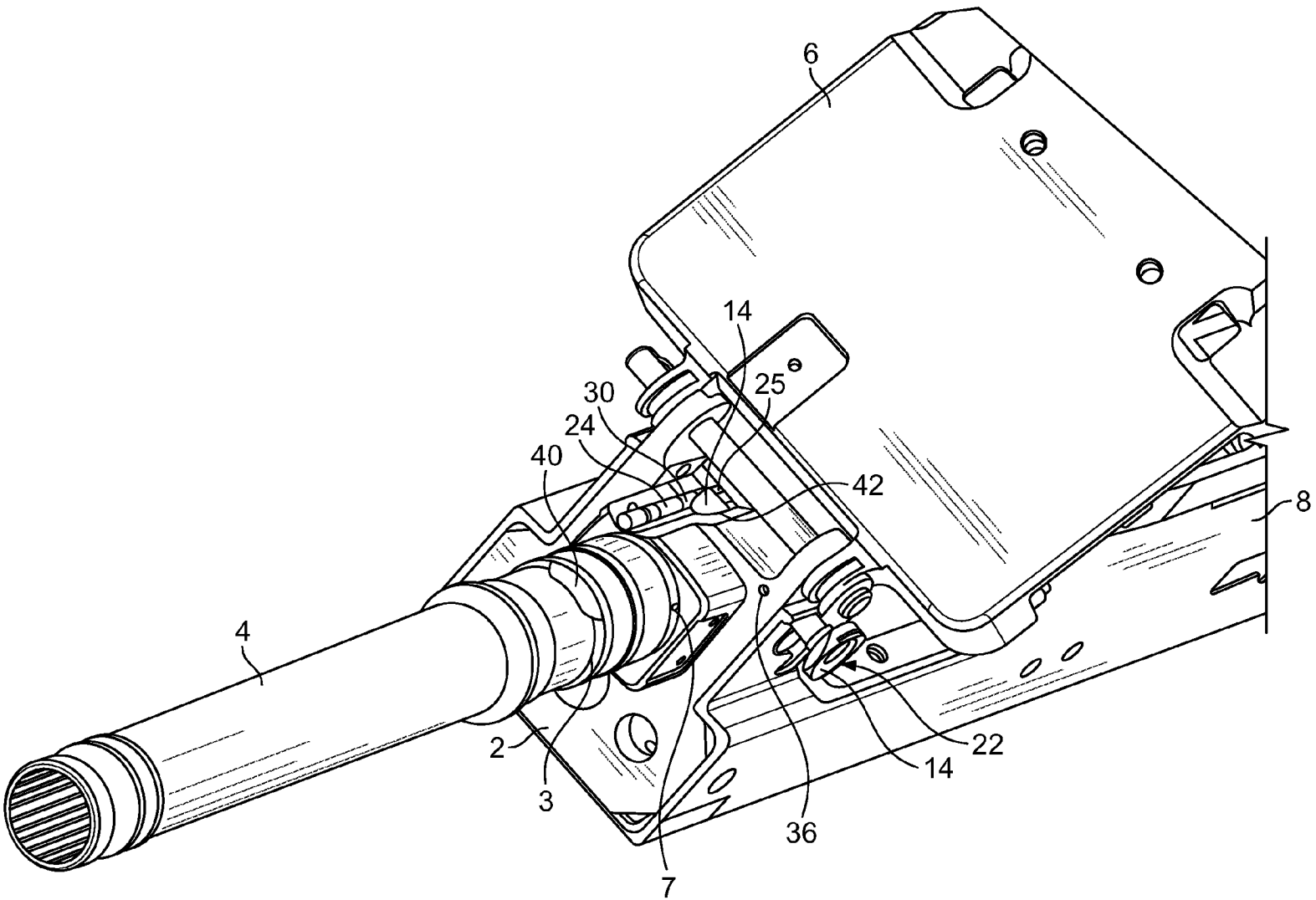
FIG. 1*c* illustrates a perspective view of the weapon of FIG. 1*a* with the interchangeable barrel partially extracted and the feeder cover in a half-open position.

FIG. 1*c* illustrates a perspective view of the example weapon 1 of FIG. 1*a* with the example interchangeable barrel 4 partially extracted and the feeder cover 6 in a half-open position. The guide ring 3 that is positioned at an end of the interchangeable barrel 4 may be provided with the groove 40 that forms a bottom section of the guide 39 for the barrel retaining element 14. Upon removal of the interchangeable barrel 4, the projection 34 (FIG. 2) of the interchangeable barrel 4 no longer engages the sensor element 24 and, therefore, the biasing force of the sensor element spring 25 returns the sensor element 24 to the second sensor element position. In the second sensor element position, the sensor element 24 may be, for example, flush with a face of the holding bracket 2, extend (e.g., protrude) out from the face of the holding bracket, etc. Additionally, in the second sensor element position, the recess 30 in the sensor pin 24 is positioned across the guide 39 and, therefore, prevents the barrel retaining element 14 from being completely inserted into the guide 39. Additionally, if the barrel retaining element 14 can not be fully inserted into the guide 39, the feeder cover 6 is prevented from being in the closed position because the barrel retaining element 14 blocks the path of the blocking plate 28.

Figure 2:
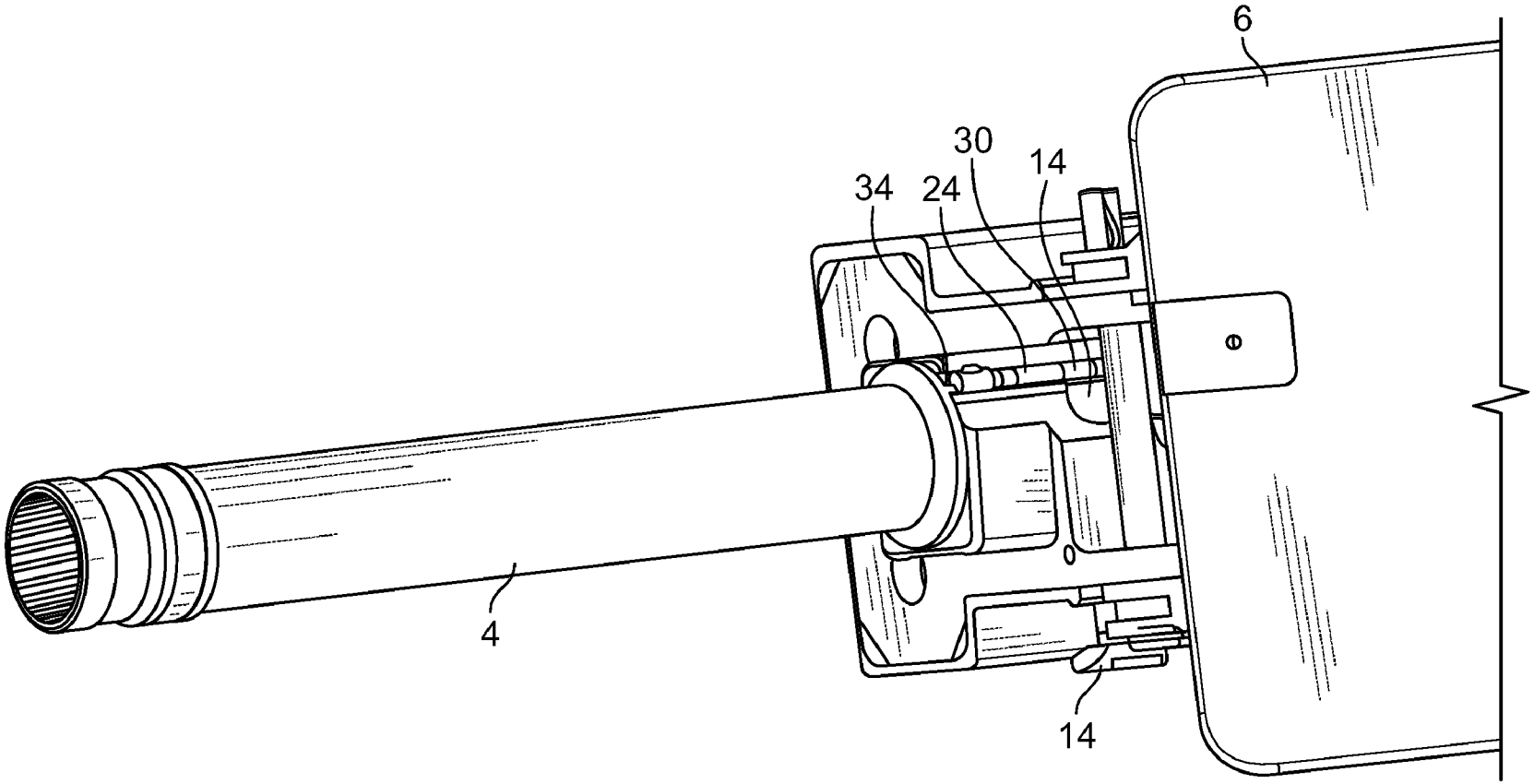
FIG. 2 illustrates a partial perspective top view of the weapon of FIG. 1*a*.

The example of FIG. 2 illustrates a partial perspective top view of the example weapon 1 of FIG. 1*a*. FIG. 2 illustrates how the projection 34 that is coupled to the interchangeable barrel 4 interacts with the sensor pin 24 and how the projection 34 may move (e.g., insert) the sensor pin 24 into the holding bracket 2. After the sensor pin 24 is inserted into the holding bracket 2 (i.e., the first sensor position) the recess 30 no longer blocks the guide 39 and, therefore, the barrel retaining element 14 may be completely inserted into the guide 39 (i.e., the locking position).

Figure 3A:
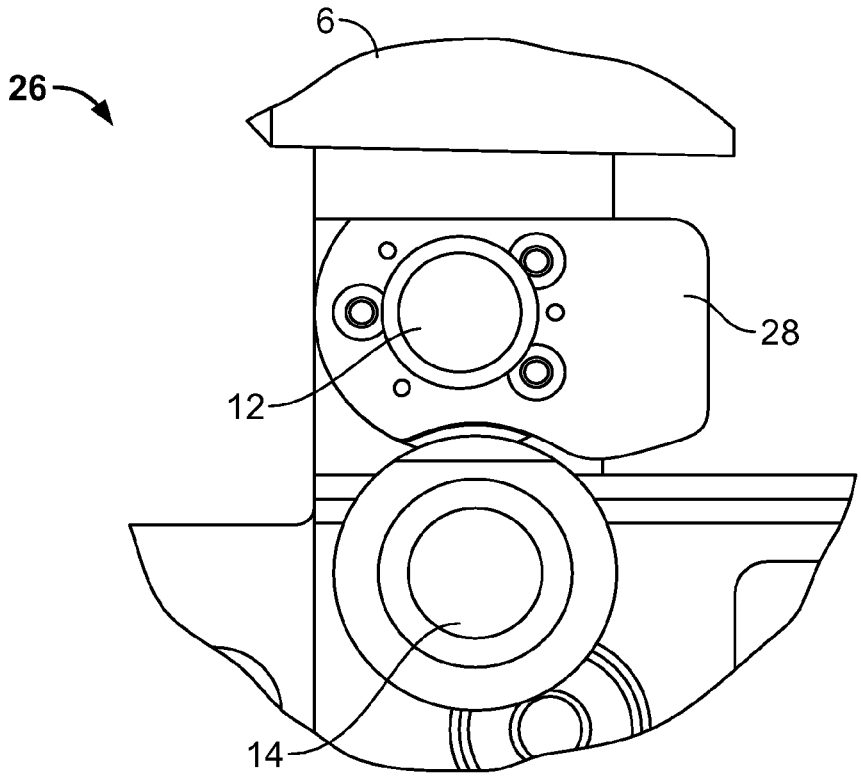
FIG. 3*a* illustrates a partial side view of the weapon of FIG. 1*a* including an example locking mechanism with the feeder cover in the open position.
Figure 3B:
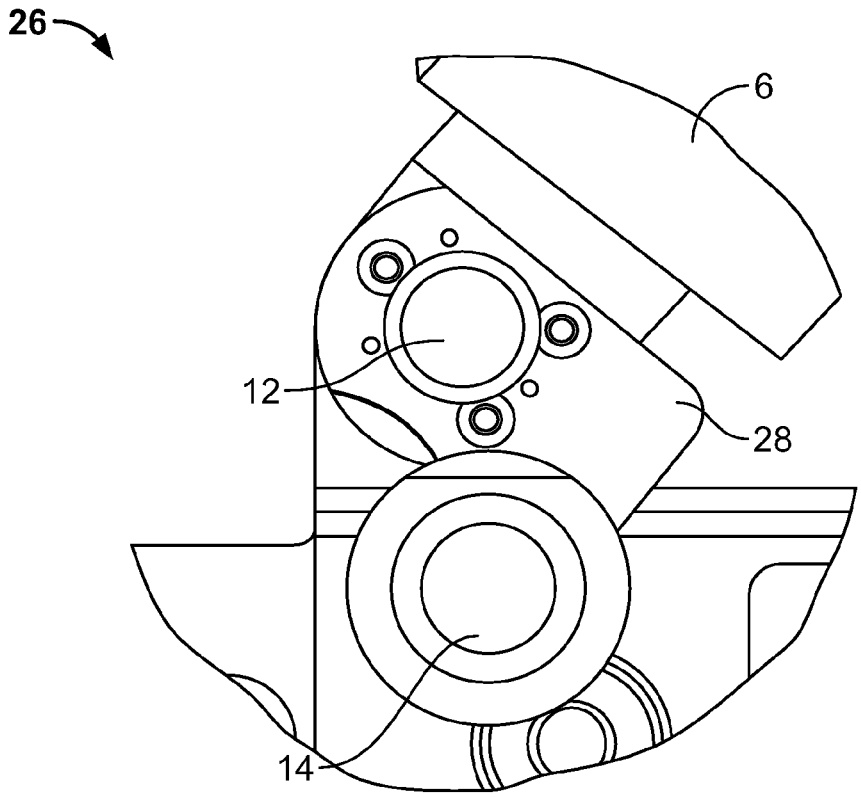
FIG. 3*b* illustrates a side view of the weapon of FIG. 1*a* including the example locking mechanism of FIG. 3*a* with the feeder cover engaging an example barrel retaining element.

The example of FIG. 3*a* illustrates a side view of the example weapon 1 of FIG. 1*a* including an example locking mechanism 26 with the feeder cover 6 in the open position (e.g., the feeder cover 6 rotated upward about 90 degrees). FIG. 3*b* illustrates a side view of the example weapon 1 of FIG. 1*a* including the example locking mechanism 26 of FIG. 3*a* with the feeder cover 6 engaging the blocking plate 28. In the illustrated example of FIG. 3*b*, the barrel retaining element 14 is not completely inserted into the guide 39 and, thus, not in the locked position.

The disclosed apparatuses and methods can be used in any suitable firearm(s) or weapon(s) that has an interchangeable barrel such as, for example, stationary guns mounted on a weapon carrier, weapons that fire small or large diameter bullets, grenade launchers, rifles, machine guns, pistols, assault weapons, machine guns for light armored vehicles, etc.

The interchangeable barrel 4 may be locked to the weapon 1 in any suitable manner such as, for example, a bayonet lock, a screw thread, or an indexing lock. As described above, the barrel locking device 22 may be provided with a barrel retaining element 14 that is any suitable barrel retaining device such as, for example, a bolt, a pin, a screw. The barrel retaining element 14 may be placed in the unlocked position or the locked position. In the locked position, the barrel retaining element 14 at-least partially locks the interchangeable barrel 4 in place. In some examples, a bolt is used as the barrel retaining element 14 and may be inserted and removed quickly in the guide 39 to exchange the interchangeable barrel 4. Alternatively, if a pin or a screw is used as the barrel retaining element 14, a tool may be required to remove the barrel retaining element 14 such as, for example, a screw driver. Additionally, in the illustrated examples, the locking mechanism 26 includes the blocking plate 28 that may be coupled to the feeder cover 6 that is at least partially (e.g., rigid). The blocking plate 28 engages the barrel retaining element 14 preventing the feeder cover 6 from being in the closed position if the barrel retaining element 14 is not in the locked position (i.e., completely inserted into the guide 39). Alternatively, if the barrel retaining element 14 is in the locked position, the feeder cover 6 may be placed in the closed position.

As stated above, the locking device 22 may be comprised of the holding bracket 2 and may be provided with the sensor element 24 that interacts with interchangeable barrel 4 and/or the barrel retaining element 14 that prevents the barrel retaining element 14 from being placed in the locked position if the interchangeable barrel 4 has not been accepted and/or locked in the holding bracket 2. The locking device 22 may ensure that the interchangeable barrel 4 is in the locked position (e.g., proper position, firing position) to seal the gas pressure that is produced when a cartridge is fired.

As stated above, the sensor element 24 may be biased by the sensor element spring 25 and positioned between the first sensor element position and the second sensor element position. The sensor element 24 may interact with the projection 34 that may be coupled to the interchangeable barrel 4. The interchangeable barrel 4 is inserted into the holding bracket 2 and the projection 34 engages the sensor element 24, overcomes the sensor element spring 25 and moves the sensor element 24 to the first sensor element position. The sensor element 24 may be provided with the recess 30 that allows the barrel retaining element 14 to be in the locked position if sensor element 24 is in the first sensor element position. The barrel retaining element 14 may be completely inserted into the guide of the holding bracket (e.g., the locked position) if the interchangeable barrel 4 has been accepted and/or locked into the holding bracket 2.

As discussed above, in the feeder cover 6 closed position, the feeder cover 6 or an element that is coupled to the feeder cover 6 (e.g., the blocking plate 28) prevents the removal of the barrel retaining element 14 by preventing the barrel retaining element 14 from being in a position other than the locked position. Being able to prevent the removal of the barrel retaining element 14 may provide additional protection against unintentional dropping, unintentional removal, etc. of the barrel retaining element 14 and/or may prevent the interchangeable barrel 4 from being unlocked.

As described above, the barrel retaining element 14 may be in a form substantially similar to a bolt and may move transverse to the interchangeable barrel 4 in the holding bracket 2. The blocking plate 28 may be coupled to the feeder cover 6 and may impact an end of the barrel retaining element 14. Additionally, the blocking plate 28 is at least partially torque proof. The blocking plate 28 may be integrally coupled to the feeder cover 6. Specifically, the blocking plate 28 may be integrally coupled to the eyelet 10 of the feeder cover 6. Alternatively, the blocking plate may be coupled to the feeder cover 6 in any other suitable manner such as, for example, welding, etc.

As discussed above, the sensor element 24 may be any suitable sensor element 24 such as, for example, a bolt, a pin, etc. that may be inserted in the holding bracket 2 substantially parallel to the interchangeable barrel 4. The sensor element 24 may be provided with the recess 30 that the barrel retaining element 14 may be guided through or, alternatively, there may be a complete opening that the barrel retaining element 14 passes through. Alternatively, the barrel retaining element 14 may be provided with a push handle that may block the guide.

In the illustrated example, the interchangeable barrel 4 is provided with the groove 40 positioned at the end of the interchangeable barrel 4 that the barrel retaining element 14 may be inserted into the holding bracket 2.

The stop pin 36 may prevent the barrel retaining element 14 from being completely removed from the weapon 1. In other examples, the barrel retaining element 14 does not include the stop pin 36.

Furthermore, although certain example methods, apparatus and articles of manufacture have been described herein, the scope of coverage of this patent is not limited thereto. On the contrary, this patent covers all methods, apparatus and articles of manufacture fairly falling within the scope of the appended claims either literally or under the doctrine of equivalents.

What is claimed is:

1. Safety apparatuses for weapons, the safety apparatus comprising:

an interchangeable barrel;

a safety mechanism, wherein the safety mechanism can be moved between an open position that corresponds to an unlocked position and a closed position that corresponds to a locked position, the safety mechanism comprising:

a feeder cover, wherein the feeder cover is part of cartridge loading equipment that supplies cartridges to the weapon, the feeder cover comprising:

a locking mechanism that engages with a barrel locking device and prevents the feeder cover from entering the closed position when the interchangeable barrel is not coupled to the weapon;

wherein the unlocked position prevents the weapon from being fired and the locked position allows the weapon to be fired; and wherein the barrel locking device couples the interchangeable barrel to the weapon and wherein the barrel locking device interacts with the safety mechanism and prevents the safety mechanism from entering the locked position when the interchangeable barrel is not coupled to the weapon via the barrel locking device.

2. The weapon as defined in claim 1, wherein the barrel locking device is provided with a barrel retaining element that can be placed in the locked position or the unlocked position and wherein in the locked position the barrel retaining element couples the interchangeable barrel to the weapon.

3. The weapon as defined in claim 2, wherein in the feeder cover closed position, the feeder cover engages the barrel retaining element and prevents the barrel retaining element from entering an other position than the locking position.

4. The weapon as defined in claim 2, wherein in the locking position the barrel retaining element is at least partially received by a groove at an end of the interchangeable barrel.

5. The weapon as defined in claim 2, wherein the weapon is provided with a stop pin that prevents the barrel retaining element from being completely removed from the weapon.

6. The weapon as defined in claim 1, wherein the locking mechanism is provided with a blocking plate that is at least partially torque proof and is coupled to the feeder cover.

7. The weapon as defined in claim 6, wherein the feeder cover engages the barrel retaining element in a position other than the locking position and prevents the feeder cover from being in the closed position.

8. The weapon as defined in claim 6, wherein the blocking plate substantially laterally engages an end of the barrel retaining element in a position other than the locked position.

9. The weapon as defined in claim 1, wherein the barrel locking device further comprises a holding bracket and a sensor element that engages the interchangeable barrel.

10. The weapon as defined in claim 9, wherein the sensor element interacts with the interchangeable barrel and the barrel retaining element and prevents the barrel retaining element from being in the locked position if the interchangeable barrel has not been received by the holding bracket.

11. The weapon as defined in claim 9, wherein the sensor element is biased by a sensor element spring and moves between a first sensor element position and a second sensor element position.

12. The weapon as defined in claim 11, further comprising a projection that is coupled to the interchangeable barrel and engages the sensor element.

13. The weapon as defined in claim 12, wherein the projection moves the sensor element against the sensor element spring substantially to a stop limit of the first sensor element position if the interchangeable barrel is received by the holding bracket.

14. The weapon as defined in claim 9, wherein the sensor element further comprises a recess that prevents the barrel retaining element from entering the locking position if the sensor element is not in the first sensor element position.

15. The weapon as defined in claim 14, wherein in the locked position the barrel retaining element at least partially engages the recess of the sensor element.

16. The weapon as defined in claim 9, wherein the sensor element is a bolt that can be inserted in the holding bracket and is positioned substantially parallel to the interchangeable barrel.

17. The weapon as defined in claim 1, wherein the barrel retaining element is a bolt that can move in the holding bracket substantially transverse to the interchangeable barrel.

18. A method of ensuring that an interchangeable barrel is coupled to a weapon, comprising, inserting a barrel into a holding bracket;

moving a sensor element from a first position to a second position;

inserting a barrel retaining element into a guide to a stop limit;

coupling the barrel to the weapon;

closing a feeder cover; and blocking removal of the barrel retaining element via the feeder cover.

19. The method of ensuring that the interchangeable barrel is coupled to the weapon of claim 18, further comprising feeding a cartridge into a cartridge chamber.

20. The method of ensuring that the interchangeable barrel is coupled to the weapon of claim 19, furthering comprising igniting the cartridge in the cartridge chamber.

* * * * *